US005421355A

United States Patent [19]

Cantwell

[11] Patent Number: 5,421,355

[45] Date of Patent: Jun. 6, 1995

[54] TENT ASSEMBLY HAVING MULTIPLE CONFIGURATIONS

[75] Inventor: Robert R. Cantwell, New Haven, Mo.

[73] Assignee: American Recreation Products, Inc., New Haven, Mo.

[21] Appl. No.: 118,041

[22] Filed: Sep. 8, 1993

[51] Int. Cl.[6] ..... E04H 15/28; E04H 15/42

[52] U.S. Cl. ..... 135/120.3; 135/115; 135/119

[58] Field of Search ..... 135/95, 97, 102, 104, 135/105, 115, 117, 119, 120, 906, 907

[56] References Cited

U.S. PATENT DOCUMENTS

| | | | |
|---|---|---|---|
| 2,345,377 | 3/1944 | Bowen | 135/104 |
| 2,938,524 | 5/1960 | Benson | 135/104 |
| 3,598,133 | 10/1971 | Abert et al. | 135/115 X |
| 3,929,146 | 12/1975 | Maiken | 135/104 X |
| 3,970,096 | 7/1976 | Nicolai | 135/104 X |
| 4,078,572 | 3/1978 | Moss | 135/105 X |
| 4,193,413 | 3/1980 | Watts et al. | 135/105 X |
| 4,269,210 | 5/1981 | Marks | 135/104 |

FOREIGN PATENT DOCUMENTS

| | | | |
|---|---|---|---|
| 2319796 | 10/1974 | Germany | 135/105 |
| 3213781 | 2/1983 | Germany | 135/104 |

*Primary Examiner*—Carl D. Friedman
*Assistant Examiner*—Kevin D. Wilkens
*Attorney, Agent, or Firm*—Senniger, Powers, Leavitt & Roedel

[57] ABSTRACT

A tent assembly capable of assuming multiple configurations includes a shell having side walls made of flexible material in which at least a portion of the flexible material is water vapor permeable, a fly of flexible water impermeable material and a frame to support the shell in a first erect configuration in which the shell substantially encloses a space sized to accommodate one or more occupants and the shell is not covered by the fly. The frame is further capable of supporting the shell and fly in a second erect configuration in which the shell encloses a space sized to accommodate one or more occupants and the fly canopies the shell to prevent substantial moisture from falling on the shell. Moreover, the frame is capable of supporting the fly in a third erect configuration in which the fly is suspended over and shelters a space sized to accommodate one or more occupants.

19 Claims, 4 Drawing Sheets

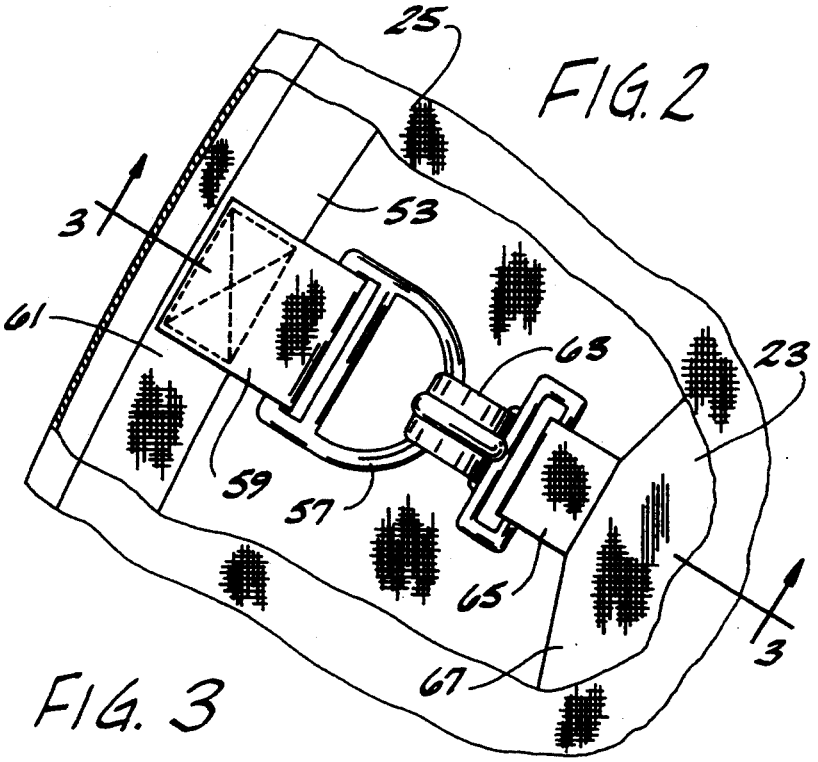
FIG. 2
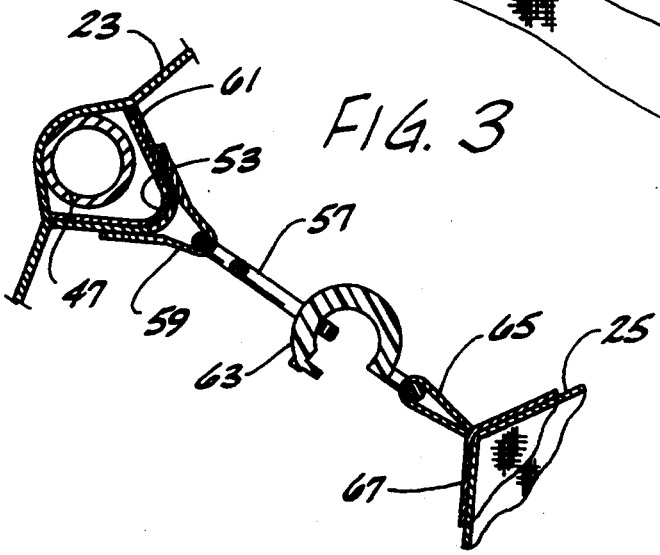
FIG. 3
FIG. 7
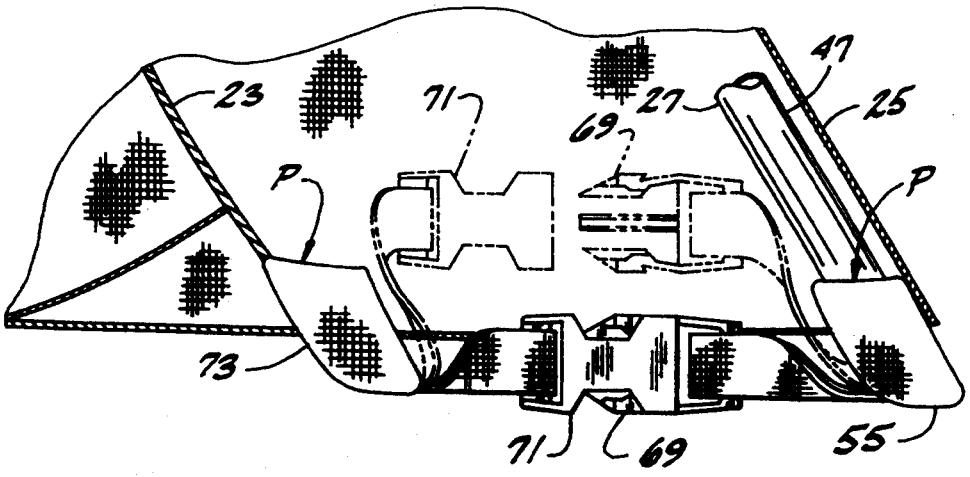

TENT ASSEMBLY HAVING MULTIPLE CONFIGURATIONS

BRIEF SUMMARY OF THE INVENTION

This invention relates generally to tents, and more particularly to a tent assembly capable of assuming multiple configurations.

Tents of conventional construction typically include a tent shell constructed of material which is totally or partially moisture permeable for proper ventilation of the tent. In a common configuration, the tent has sleeves attached to the shell for receiving poles of a frame support. These poles are inserted into the sleeves and are flexed to an inverted-U shape to erect the tent. A fly impermeable to moisture is provided for covering the tent shell and frame in a position in which the fly is spaced from the tent shell. Conventionally, the only two configurations available are erecting the tent shell without the fly or erecting the tent shell with the fly.

There is presently a need for a tent capable of being configured in multiple configurations so as to provide its user various options of erecting the tent based upon climate conditions and the desired function of the tent. For instance, on occasion protection from the elements will be unnecessary while it will be desirable to have some protection from insects (e.g., particularly in the evening or at night). In that event, a screen room is needed. On other occasions, such as during the middle of the day, the primary need may be shade rather than protection from insects. An open shelter made of a material which blocks at least some sunlight is needed. Finally, in the usual situation, where the tent is to be used as a temporary dwelling for sleeping, changing clothes etc., both protection from the elements and insects are required.

Among the several objects of this invention may be noted the provision of a tent assembly capable of being erected in multiple configurations, such as a screen room or a shelter substantially impermeable to moisture; the provision of such a tent assembly having a tent shell which can be selectively connected, in an easy and time-efficient manner to a frame or to a fly; the provision of such a tent assembly in which the fly is securely connected to the frame; the provision of such a tent assembly which is sturdy and durable; and the provision of such a tent assembly which is of economical construction.

Generally, this invention is directed to a tent assembly capable of assuming multiple configurations. The tent assembly comprises a shell including side walls made of flexible material in which at least a portion of the flexible material is water vapor permeable. The tent assembly further comprises a fly of flexible, water impermeable material and a frame adapted to support the shell in a first erect configuration in which the shell substantially encloses a space sized to accommodate one or more occupants and the shell is not covered by the fly. The frame is further adapted to support the shell and fly in a second erect configuration in which the shell encloses a space sized to accommodate one or more occupants and the fly canopies the shell to prevent substantial moisture from falling on the shell. Moreover, the frame is adapted to support the fly in a third erect configuration in which the fly is suspended over and shelters a space sized to accommodate one or more occupants. First connector means is associated with the fly and is constructed and arranged for connecting the fly to the frame. Second connector means is associated with the shell and is constructed and arranged for connection to the frame in the first erect configuration and for connection to the first connector means in the second erect configuration. The first and second connector means is constructed to maintain a space between the shell and the fly.

Other objects and features will be in part apparent and in part pointed out hereinafter.

BRIEF DESCRIPTION OF THE DRAWINGS

FIG. 2 is an enlarged, fragmentary front elevation of the tent assembly of FIG. 1 showing connection of the shell and fly;

FIG. 3 is a section taken on line 3—3 of FIG. 2;

FIG. 7 is an enlarged view of a snap locking connector and a receiving pocket of the present invention.

Corresponding reference characters indicate corresponding parts throughout the several views of the drawings.

DETAILED DESCRIPTION OF THE PREFERRED EMBODIMENT

Figure 1:
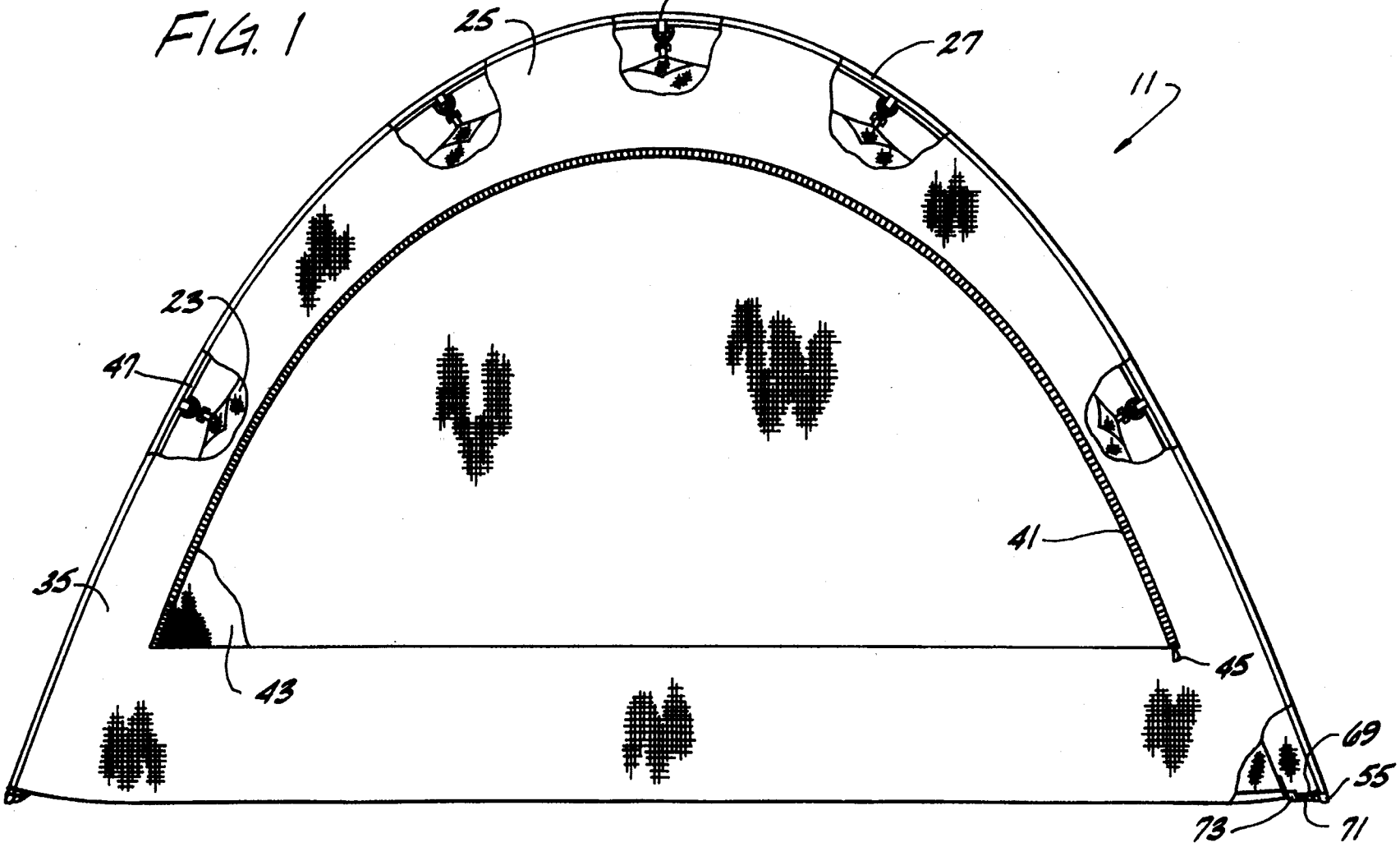
FIG. 1 is a front elevation of a tent assembly in an erect configuration having portions of its shell and fly removed to show connectors of the present invention.
Figure 4:
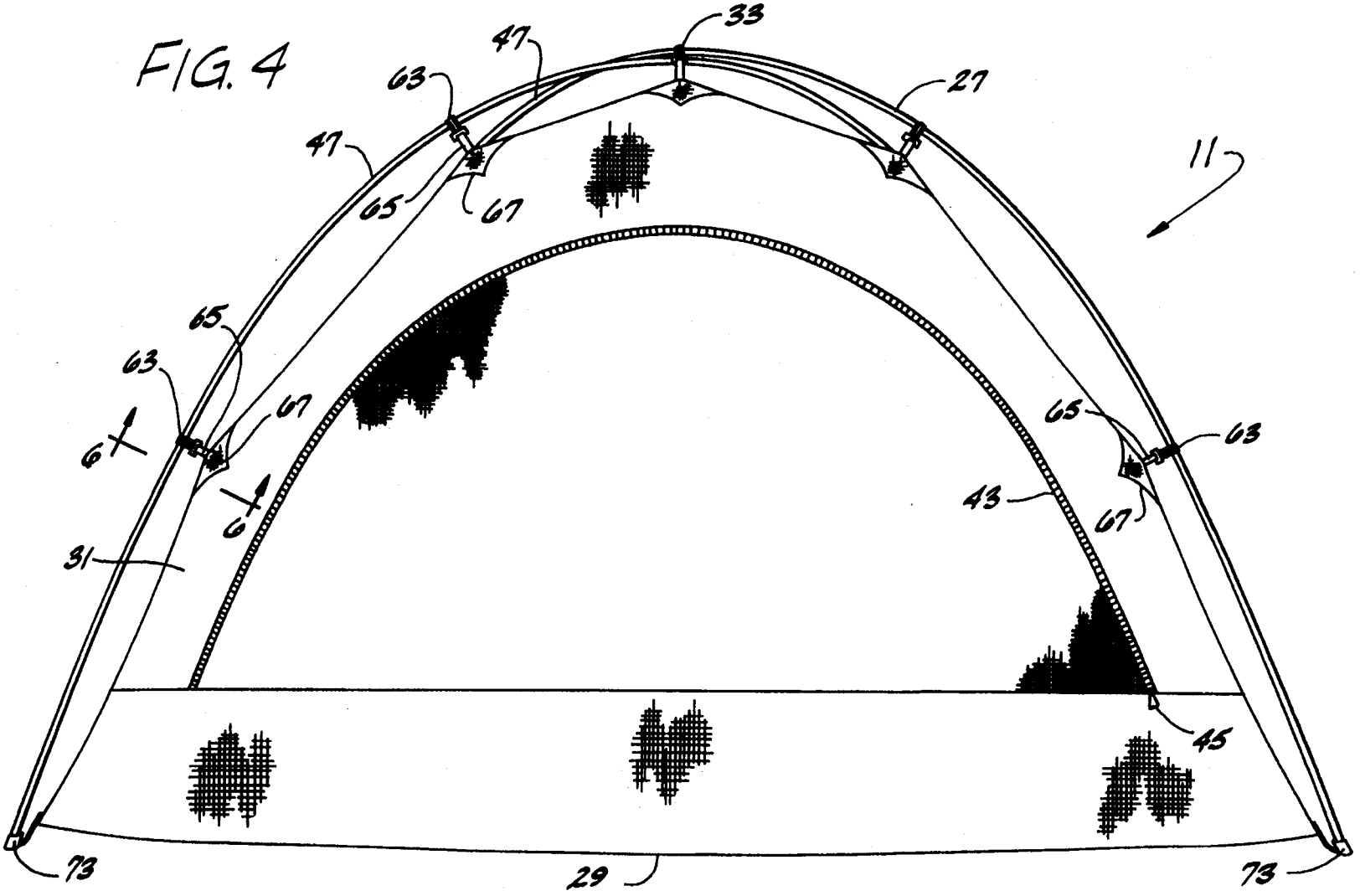
FIG. 4 is a front elevation of the tent assembly in another erect configuration.
Figure 5:
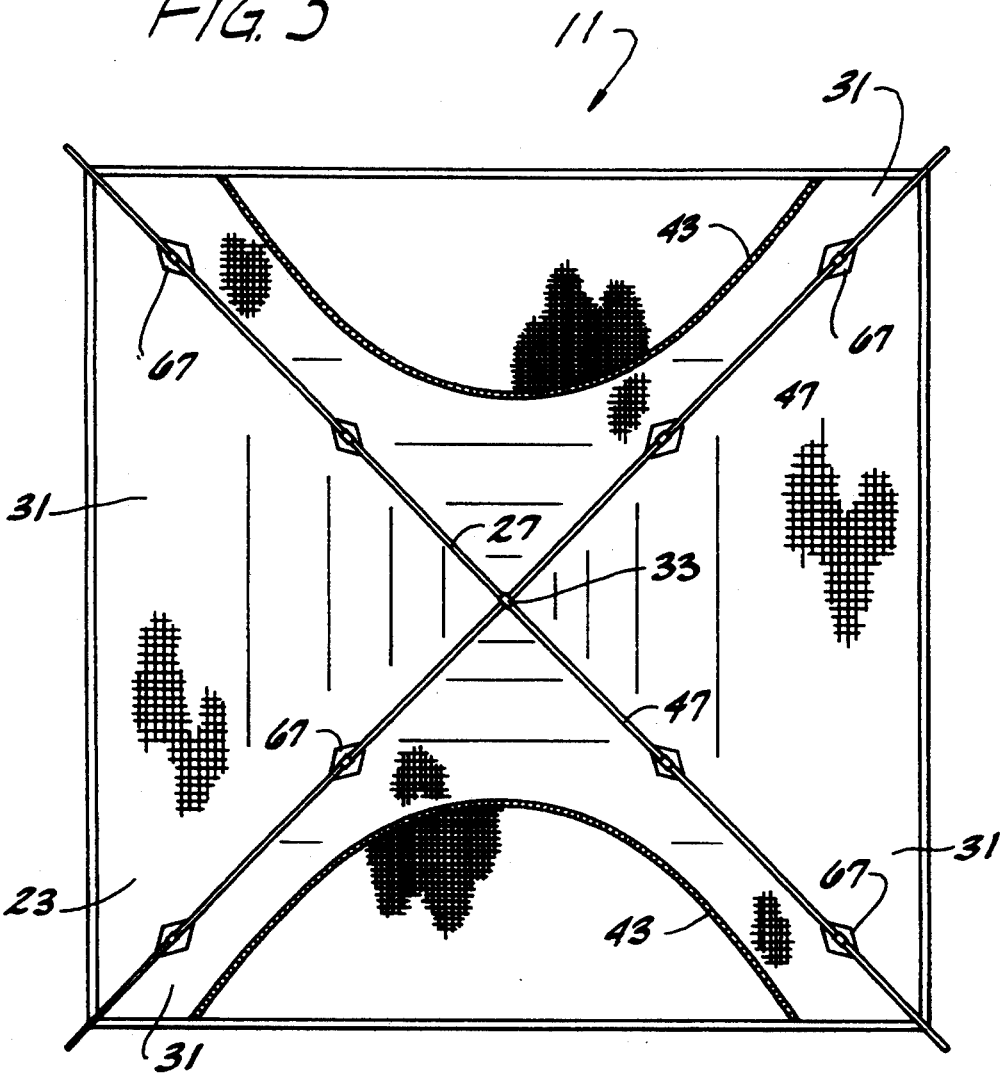
FIG. 5 is a top plan of the tent assembly shown in FIG. 4.

Referring now to the drawings, a tent assembly constructed according to the principles of this invention is designated in its entirety by the reference numeral 11. The tent assembly 11 depicted in the drawings is what may be referred to in the tent industry as a "dome" tent, which includes a bottom and four sides. As illustrated in FIGS. 1, 4 and 5, the tent assembly 11 includes three main components: a shell 23 made of flexible material; a fly 25 made of flexible water impermeable material; and a frame 27. The shell 23 has a bottom 29 and four side walls, each designated 31, extending upwards from the bottom and terminating adjacent to the top of the tent assembly indicated at 33 in FIG. 4. The side walls 31 of the shell are joined at their lateral edge margins (as by stitching) to the lateral edge margins of adjacent walls along generally upwardly extending corner seams and to the bottom 29 along lower horizontal seams. The shell bottom 29 is made from water impermeable material (e.g., sheet plastic material), whereas the side walls 31 are preferably made from mesh screen material which is water vapor permeable. The shell side walls 31 should be constructed to permit the shell to breathe by allowing water vapor to pass through them. However, the shell side walls may be only partially constructed of breathable material and still fall within the scope of the present invention. The fly 25 also has four side walls, each designated 35, but does not have a bottom, and is sized and shaped for covering the entire tent shell 23. The construction of the fly 25 is similar to that of the shell in that adjacent side walls 35 of the fly are joined at their lateral edge margins in generally upwardly extending corner seams. The frame 27 is capable of supporting the shell 23, or the fly 25, or both as desired. It is envisioned that the principles of the present invention may apply to tents configured in other ways such as the tent shown in U.S. Pat. No. 3,943,953 which has four walls and a peaked roof.

The shell 23 and fly 25 of tent assembly 11 each have two openings formed in oppositely positioned side walls. The openings in the shell and fly are sufficiently sized to permit the passage of an adult through them into or out of the tent. As illustrated in the drawings, a door 41 formed in a side of the fly 25 is generally in registration with a similarly constructed door 43 formed in a corresponding side of the shell 23. Thus, in order to gain access into the tent assembly 11, both the fly and shell doors 41, 43 must be opened. A zipper 45 of standard construction is provided for each door (41 and 43) for opening and closing the door. It is to be understood that other connection devices, such as snap fasteners or hook and loop fastening material, may also be used to secure the doors in the closed position. The overlying doors 41, 43 are semi-circular in shape.

The frame of the present invention embodies two flexible poles, each designated 47, made of light-weight aluminum, for example. The poles 47 are configurable in a flexed tent supporting position to support the shell 23 only, the fly 25 only, or both the shell and fly. Each pole 47 comprises a series of slender, hollow members connected to each other in line by an elastic cord, as is well known in the tent industry. Adjacent members of a pole 47 are adapted to be releasably interconnected to form one long continuous pole capable of being flexed. In their relaxed positions, the poles 47 are generally straight. The poles may be flexed into an inverted-U shaped configuration for supporting the fly 25 and/or shell 23. In a first erect configuration of the tent assembly 11, the frame 27 supports the shell 23 by itself so that the shell encloses a space sized to accommodate one or more occupants. In this configuration, the tent assembly 11 functions as a screen room in which air circulates within the space and the occupants may be protected from insects. FIG. 1 illustrates the tent assembly in a second erect configuration in which the frame 27 supports both the shell 23 and the fly 25. In a second erect configuration of the tent assembly, shown in FIG. 1, the shell 23 encloses a space sized to accommodate one or more occupants and the fly 25 canopies the shell to prevent substantial moisture from falling on the shell. In the illustrated embodiment, the fly 25 is sized and shaped for covering the entire tent shell 23. In this second configuration, the tent assembly 11 functions in the conventional way, with the occupants sheltered from both falling moisture and incursions of insects while the tent remains ventilated. The fly 25 provides privacy for the occupants for sleeping or changing clothes. A third erect configuration of the tent assembly 11 comprises the frame 27 supporting the fly 25, as shown in FIG. 1, but without the shell 23. In this configuration the fly doors 41 are open and the tent assembly 11 functions as a canopy providing some shade and protection from the weather for several occupants.

Connecting the fly 25 to the two poles 47 of the frame 27 (to achieve the second and third erect configurations) are two series of sleeves 53 mounted on the interior surface of the fly. Each series of sleeves 53 extends diagonally across the fly 25 generally from corner to corner of the fly. Each sleeve 53 is constructed to receive a pole 47 of the frame 27 in a manner well known in the tent industry. The sleeves 53 forming a series of sleeves are spaced apart in line for the facilitating the threading of a pole 47 therein, however, it is to be understood that the provision of one continuous sleeve per pole may work as well. Each series of sleeves 53 are joined to the interior surface of the fly 25 by stitching and are specifically located at the seam between the side walls 35 of the fly thereby defining a crisscross shape as viewed from above.

A pair of pole receiving pockets, each designated 55, one pair associated with each pole 47, are attached to the fly 25 for receiving the ends of the corresponding pole and for holding the pole in a flexed position. There is one pole receiving pocket 55 associated with each corner of the fly 25 of the tent assembly 11. Each pole receiving pocket 55 is made from a piece of flexible material (e.g., cloth) which is overlapped and stitched at one end to form a pocket P and is attached at its other end to the fly 25 by stitching.

Spaced at intervals and mounted on the interior of the fly 25 are a plurality of D-rings 57 which, along with the sleeves 53, constitute the "first connector means" in this embodiment of the present invention. Each D-ring 57 is connected to the interior surface of the fly 25 by a strap 59 which is attached to a reinforcing patch 61 mounted on the sleeve. The patches 61 are stitched to the interior surface of the fly 25 on the sleeve 53 all around their peripheries. Each strap 59 is connected at one end to the patch 61 and at the opposite end to the D-ring 57.

Figure 6:
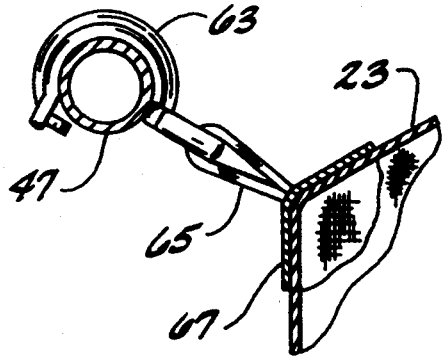
FIG. 6 is an enlarged, fragmentary section taken on line 6—6 of FIG. 4.

Mounted on the exterior surface of the shell 23, in registry with the D-rings 57 of the fly 25, are a plurality of quick-connect fasteners 63 (broadly, "second connector means") for fastening the shell to the frame 27 in the first erect configuration (see FIGS. 4–6) or fastening the shell to the D-rings associated with the fly 25 in the second erect configuration (see FIGS. 1–3). Each fastener 63 is also connected by a strap 65 to a reinforcing patch 67 mounted on the exterior surface of the shell 23 in a position corresponding to a respective D-ring 57. The fastener strap 65 is joined at one of its ends to the patch 67 and at its other end to the fastener 63. The fastener patches 67 are secured to the exterior of the shell 23 by stitching all around their peripheries. As illustrated in FIGS. 3 and 6, the fasteners 63 are generally hook shaped and constructed for releasable snap-on connection to a pole 47 of the frame 27. For connecting the fly 25 to the shell 23, the hook of each fastener 63 is connected to a respective D-ring 57 by inserting the hook of the fastener through the opening defined by the D-ring in the manner shown in FIGS. 2 and 3. When connecting the shell 23 to the fly 25, the D-rings 57 and fasteners 63 are constructed and arranged to maintain a space between the shell and the fly. This is desirable since water has a tendency to penetrate the interior of the shell 23 when the fly 25 touches the shell. Thus, in order to prevent water from entering the tent shell 23, a space should be provided between the shell and the fly 25.

As shown in FIG. 5, there are nine fasteners 63 and likewise, nine D-rings 57. Four fasteners and D-rings are located along each pole 47 and one fastener and D-ring is positioned at the apex of the tent assembly 11 at 33. It is to be understood that any number of connectors may be sufficient so long as the stability of the tent is ensured.

Referring now to FIG. 7, connecting the lower portions of the shell 23 to the lower portions of the fly 29 (i.e., when erecting the tent assembly 11 in its second erect configuration) at the corners of the tent assembly 11 are releasably engageable snap locking connectors 69 and 71 of the present invention. Tent assembly 11 includes four first snap locking connectors 69 connected by a strap 70 to the fly 25 and four second snap locking 71 connectors connected by a strap 72 to the shell 23. The first and second snap locking connectors 69, 71 are connected to their respective fly 25 and shell 23 at the four corners of the tent assembly 11 and are located generally at the bottom of the tent in opposed relation to each other. A first snap lock connector 69 is releasably snap locked to its associated second snap lock connector 71 to further securely hold the fly 25 on the shell 23.

When erecting the tent assembly 11 in its first erect configuration (i.e., shell 23 only), the hook-shaped fasteners 63 are directly snapped onto the erected frame 27 rather than interconnected with D-rings 57. In order to securely connect the shell 23 to the frame 27, each fastener 63 has a mouth sized smaller that the transverse dimension of the poles 47 (i.e., the diameter of the pole) whereby the fastener is deformed upon passage of the pole through the mouth into the fastener and snaps around the pole upon entry of the pole into the fastener to capture the pole within the fastener. The ends of the hook-shaped fasteners 63 are flared outwardly so that they may be easily deformed for removing the fasteners from a respective pole.

The shell 23 is also provided with two pairs of pole receiving pockets, each designated 73, identical to pole receiving pockets 55. Each pole receiving pocket of a pair of pole receiving pockets 73, each having pockets P, is located at diagonally opposite corners of the tent shell 23. Each pair of diagonally opposed pole receiving pockets 73 is associated with one of the poles 47 for receiving the respective ends of the pole and for holding the pole in a flexed position. Pole receiving pockets 73 are configured and attached to the shell 23 in a manner identical to pole receiving pockets 55.

In use, the tent assembly 11 may be constructed in one of three configurations. In the first configuration, the frame is erected such that the poles 47 are inserted into respective pole receiving pockets 73 of the shell 23. All nine fasteners 63 of the shell 23 are then snapped-on the poles 47 so that the external frame 27 supports the shell 23 (see FIGS. 4 and 5). In this configuration, the tent assembly 11 primarily functions as a screen room in which air circulates within the space and the occupants may be protected by the mesh screen shell 23 from insects. In the second configuration, the poles 47 of the frame are inserted into the sleeves 53 mounted on the underside of the fly 25 such that the ends of the poles are held captive by respective pole receiving pockets 55 attached to the fly. The shell 23 is placed in the space defined by the fly 25 and oriented such that the doors 43 of the shell correspond to the doors 41 of the fly. Next, the fasteners 63 of the shell 23 (i.e., the same fasteners which were attached to the poles) are interconnected with D-rings 57 attached to the interior surface of the fly 25 in registry with the fasteners. After all nine fasteners 63 are connected with respective D-rings 57, the four corners of the shell 23 are attached to the four corners of the fly 25 by interconnecting the snap locking connectors 69, 71. In this second configuration, the shell 23 and fly 25 function as a waterproof, private shelter in which air may still circulate within the space. In the third configuration, only the frame 27 and fly 25 (i.e., not the shell 23) are erected as described in the second configuration. When the fly doors 41 are opened, the tent assembly 11 functions as a canopy to provide some shade and protection to its occupants from the weather while permitting a view of the surrounding countryside.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A tent assembly capable of assuming multiple configurations, the tent assembly comprising:

a shell including side walls made of flexible material, at least a portion of the flexible material being water vapor permeable;

a fly of flexible water impermeable material;

a frame adapted to support the shell in a first erect configuration in which the shell substantially encloses a space sized to accommodate one or more occupants and the shell is not covered by the fly, adapted to support the shell and fly in a second erect configuration in which the shell encloses a space sized to accommodate one or more occupants and the fly canopies the shell to prevent substantial moisture from falling on the shell, and adapted to support the fly in a third erect configuration in which the fly is suspended over and shelters a space sized to accommodate one or more occupants;

first connector means associated with the fly, said first connector means being constructed and arranged for connecting the fly to the frame;

second connector means associated with the shell, said second connector means being constructed and arranged for connection to the frame in said first erect configuration and for connection to said first connector means in said second erect configuration, said first and second connector means being constructed to maintain a space between the shell and the fly.

2. A tent assembly as set forth in claim 1 wherein the shell is supported by the fly in said second erect configuration and is free of connection to the frame.

3. A tent assembly as set forth in claim 1 wherein the shell side walls are made of a mesh screen material whereby in said first erect configuration the tent assembly is formed as a screen room.

4. A tent assembly as set forth in claim 3 wherein the fly is sized and shaped for covering the entire tent shell in said second erect configuration.

5. A tent assembly as set forth in claim 4 wherein the fly is formed with a closure adapted to be selectively moved away from the fly to expose an opening in the fly sized and shaped to permit passage of an adult through the opening into or out of the tent assembly.

6. A tent assembly as set forth in claim 1 wherein said second connector means comprises a plurality of quick-connect fasteners adapted to fasten to the frame in said first erect configuration of the shell and to fasten to said first connector means in said second erect configuration.

7. A tent assembly as set forth in claim 6 wherein the quick-connect fasteners are hook-shaped and constructed for releasable snap-on connection to the frame.

8. A tent assembly as set forth in claim 6 wherein said first connector means comprises at least one sleeve joined to the fly and adapted to receive portions of the frame therein for connecting the fly to the frame and a plurality of ring connectors sized and arranged for being hooked to respective quick-connect fasteners of the shell.

9. A tent assembly as set forth in claim 8 wherein said first connector means further comprises a reinforcing patch and connecting strap for each of the ring connectors, the patch being joined to the fly and the strap being joined at one end to the patch and at the opposite end to the ring connector, and wherein said second connector means further comprises a reinforcing patch and connecting strap for each of the quick-connect fasteners, the patch being joined to the shell and the strap being joined at one end to the patch and at the opposite end to the quick-connect fastener.

10. A tent assembly as set forth in claim 9 wherein the reinforcing patches joined to the fly are joined to the fly by stitching all around their peripheries, and wherein the reinforcing patches joined to the shell are joined to the shell by stitching all around their peripheries.

11. A tent assembly as set forth in claim 1 further comprising snap locking connector means including a plurality of first snap locking connectors associated with the fly, a plurality of second snap locking connectors associated with the shell, the first and second snap locking connectors being adapted to be located generally at the bottom of the tent assembly in opposed relation to each other in said second erect configuration and to be snap locked together to securely hold the fly on the shell.

12. A tent assembly as set forth in claim 1 wherein the frame comprises at least two flexible poles configurable in a flexed tent supporting position, and wherein the fly has a pair of pole receiving pockets for each of the poles, each pole receiving pocket of a pair of pole receiving pockets being adapted to receive an end of one of said poles and hold said one pole in the flexed position.

13. A tent assembly as set forth in claim 12 wherein the shell has a pair of pole receiving pockets for each of the poles, each pole receiving pocket of a pair of pole receiving pockets being adapted to receive an end of one of said poles and hold said one pole in the flexed position.

14. A tent comprising:

a shell including side walls made of flexible material being water vapor permeable;

a fly of flexible water impermeable material;

a frame adapted to support the shell and fly in an erect configuration in which the shell encloses a space sized to accommodate one or more occupants and the fly canopies the shell to prevent substantial moisture from falling on the shell;

first connector means associated with the fly, said first connector means being constructed and arranged for connecting the fly to the frame;

second connector means associated with the shell, said second connector means being constructed and arranged for connection to said first connector means in the erect configuration and to maintain a space between the fly and the shell in the erect configuration;

said first and second connector means comprising quick-connect fasteners.

15. A tent as set forth in claim 14 wherein the shell is supported by the fly in said erect configuration and is free of connection to the frame.

16. A tent comprising:

a shell including side walls made of flexible material, at least a portion of the flexible material being water vapor permeable;

a fly of flexible water impermeable material;

a frame adapted to support the shell and fly in an erect configuration in which the shell encloses a space sized to accommodate one or more occupants and the fly canopies the shell to prevent substantial moisture from falling on the shell;

first connector means associated with the fly, said first connector means being constructed and arranged for connecting the fly to the frame;

second connector means associated with the shell, said second connector means being constructed and arranged for connection to said first connector means in the erect configuration and to maintain a space between the fly and the shell in the erect configuration;

the shell being supported by the fly in said erect configuration and being free of connection to the frame;

said second connector means comprising a plurality of quick-connect fasteners adapted to fasten to said first connector means in the erect configuration.

17. A tent as set forth in claim 16 wherein said first connector means comprises at least one sleeve joined to the fly and adapted to receive portions of the frame therein for connecting the fly to the frame and a plurality of ring connectors sized and arranged for being fastened to respective quick-connect fasteners.

18. A tent set forth in claim 17 wherein said first connector means further comprises a reinforcing patch and connecting strap for each of the ring connectors, the patch being joined to the fly and the strap being joined at one end to the patch and at the opposite end to the ring connector, and wherein said second connector means further comprises a reinforcing patch and connecting strap for each of the quick-connect fasteners, the patch being joined to the shell and the strap being joined at one end to the patch and at the opposite end to the quick-connect fasteners.

19. A tent as set forth in claim 18 further comprising snap locking connector means including a plurality of first snap locking connectors associated with the fly, a plurality of second snap locking connectors associated with the shell, the first and second snap locking connectors being adapted to be located generally at the bottom of the tent in opposed relation to each other in the erect configuration and to be snap-locked together to securely hold the fly on the shell.

* * * * *